US006227799B1

(12) United States Patent
Kuhn et al.

(10) Patent No.: US 6,227,799 B1
(45) Date of Patent: May 8, 2001

(54) TURBINE SHAFT OF A STEAM TURBINE HAVING INTERNAL COOLING, AND ALSO A METHOD OF COOLING A TURBINE SHAFT

(75) Inventors: Ralf Kuhn, Düsseldorf; Stefan Sasse, Duisburg; Andreas Ulma, Mülheim an der Ruhr; Andreas Feldmüller, Bochum, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/472,218

(22) Filed: Dec. 27, 1999

Related U.S. Application Data

(63) Continuation of application No. PCT/DE98/01618, filed on Jun. 15, 1997.

(30) Foreign Application Priority Data

Jun. 27, 1997 (DE) ..... 197 27 406

(51) Int. Cl.[7] ..... F01D 5/14
(52) U.S. Cl. ..... 415/115
(58) Field of Search ..... 415/111, 112, 415/115; 416/97 R

(56) References Cited

U.S. PATENT DOCUMENTS

| | | | | |
|---|---|---|---|---|
| 1,820,725 | * | 8/1931 | Bailey | 415/115 |
| 2,434,901 | * | 1/1948 | Buck et al. | 415/112 |
| 2,469,732 | * | 5/1949 | Kalitinsky | 415/112 |
| 2,470,780 | * | 5/1949 | Ledwith | 415/110 |
| 2,636,665 | * | 4/1953 | Lombard | 415/115 X |
| 2,672,013 | * | 3/1954 | Lundquist | 415/115 X |
| 2,680,001 | * | 6/1954 | Batt | 415/115 |
| 2,788,951 | * | 4/1957 | Flint | 415/112 |
| 2,883,151 | * | 4/1959 | Dolida | 416/96 R |
| 3,844,110 | * | 10/1974 | Widlansky et al. | 415/60 X |
| 4,086,759 | * | 5/1978 | Kartensen et al. | 415/112 X |
| 4,573,808 | | 3/1986 | Katayama . | |
| 4,786,238 | * | 11/1988 | Glaser et al. | 415/175 X |
| 5,054,996 | | 10/1991 | Carreno . | |
| 5,088,890 | * | 2/1992 | Jewess | 415/112 |
| 5,144,794 | * | 9/1992 | Kirikami et al. | 415/115 X |
| 5,279,111 | * | 1/1994 | Bell et al. | 415/115 X |
| 5,327,719 | * | 7/1994 | Mazeaud et al. | 415/115 X |
| 5,498,131 | | 3/1996 | Minto . | |
| 5,507,620 | | 4/1996 | Primoschitz et al. | 416/97 R |
| 5,555,721 | * | 9/1996 | Bourneuf et al. | 415/115 X |
| 5,605,045 | * | 2/1997 | Halimi et al. | 415/177 X |
| 5,611,197 | * | 3/1997 | Bunker | 415/115 X |
| 5,695,319 | | 12/1997 | Matsumoto et al. . | |
| 6,010,302 | * | 1/2000 | Oeynhausen | 415/115 |

FOREIGN PATENT DOCUMENTS 195 31 290 A1 2/1997 (DE) .

OTHER PUBLICATIONS

Patent Abstracts of Japan No. 59–34402 A (Tsubouchi), dated Feb. 24, 1984.
International Publication No. WO 97/25521 (Oeynhausen), dated Jul. 17, 1997.

* cited by examiner

*Primary Examiner*—John E. Ryznic
(74) *Attorney, Agent, or Firm*—Herbert L. Lerner; Laurence A. Greenberg; Werner H. Stemer

(57) ABSTRACT

A turbine shaft for a steam turbine, in particular having a high-pressure and an intermediate-pressure turbine section. The turbine shaft has in its interior a cooling line for passing cooling steam. The cooling line is connected, on the one hand, to an outflow line and, on the other hand, to an inflow line. In this way, steam cooling of the turbine shaft can be achieved by feeding steam from the high-pressure turbine section via the inflow line to the intermediate-pressure turbine section through the outflow line. The invention also relates to a method of cooling a turbine shaft of a steam turbine.

20 Claims, 2 Drawing Sheets

TURBINE SHAFT OF A STEAM TURBINE HAVING INTERNAL COOLING, AND ALSO A METHOD OF COOLING A TURBINE SHAFT

CROSS-REFERENCE TO RELATED APPLICATION

This is a continuation of copending International Application PCT/DE098/01618, filed Jun. 15, 1997, which designated the United States.

BACKGROUND OF THE INVENTION

FIELD OF THE INVENTION

The invention relates to a turbine shaft of a steam turbine, in particular for accommodating the high-pressure and intermediate-pressure blading, and also to a method of cooling the turbine shaft of a steam turbine.

The use of steam at higher pressures and temperatures helps to increase the efficiency of a steam turbine. The use of such steam imposes increased requirements on the corresponding steam turbine. A single-line steam turbine having a high-pressure turbine section and an intermediate-pressure turbine section as well as a downstream low-pressure turbine section is suitable in the case of a steam turbine in a power range of several 100 MW. Both the high-pressure moving blades and the intermediate-pressure moving blades are accommodated by the turbine shaft, which if need be is composed of a plurality of segments. Each turbine section may have an inner casing and an outer casing, which in each case are, for example, split horizontally and bolted together. The live-steam state characterized by the high-pressure steam may be at around 170 bar and 540° C. In the course of increasing the efficiency, a live-steam state of up to 270 bar and 600° C. may be aimed at. The high-pressure steam is fed to the turbine shaft and flows through the high-pressure blading up to a discharge connection. The steam expanded and cooled down in the process may be fed to a boiler and heated up again there. The steam state at the end of the high-pressure turbine section is designated below as "cold reheating", and the steam state after leaving the boiler is designated below as "hot reheating". The steam issuing from the boiler is fed to the intermediate-pressure blading. The steam state may be around 30 bar up to 50 bar and 540° C., an increase to a steam state of about 50 bar up to 60 bar and 600° C. being aimed at. In a steam-inflow region, in particular of the intermediate-pressure turbine section, configuration measures in which the turbine shaft is protected from direct contact with the steam via a shaft screen may be carried out.

In Published, Non-Prosecuted German Patent Application DE 195 31 290 A1 there is specified a rotor for thermal turbo-engines, containing a compressor part, disposed on a shaft, a central part and a turbine part. The rotor is made up predominantly of individual welded-together bodies of rotation, the geometrical shape of which leads to the formation of axially symmetrical cavities between the respectively neighbouring bodies of rotation. The rotor has an axially directed cylindrical cavity, reaching from the end of the rotor on the inflow side to the last cavity on the upstream side. Placed in this cylindrical cavity are at least two tubes of diameters and lengths differing from one another. This is intended to allow the rotor of the turbo-engine to be brought to its operating state within the shortest time and to be easy to regulate thermally, i.e. according to requirements, heatable or coolable with relatively little effort.

U.S. Pat. No. 5,054,996 concerns a gas turbine rotor containing rotor discs interconnected by an axial tie rod. Air is directed through the gas turbine rotor, whereby the rotor and the rotor discs are heatable and coolable essentially uniformly.

U.S. Pat. No. 5,498,131 discloses a steam turbine installation with a system for reducing thermomechanical stresses, which may occur in a turbine shaft during the starting up or shutting down of the steam turbine installation. For this purpose, the steam turbine installation has a high-pressure turbine section and an intermediate-pressure turbine section with a single turbine shaft, which has a central bore passing right the way through. The central bore can be supplied with steam via a separate supply system for steam, respectively outside the casing of the turbine sections, during the starting up or shutting down of the steam turbine installation. Between the two turbine sections, i.e. approximately at the center of the turbine shaft, the steam is discharged again from the central bore. The system makes it possible for the transient starting-up or shutting-down state to be passed through in a short time in an improved and controlled manner.

In Patent Abstract of Japan N-303, Jun. 20, 1984, Vol. 8, No. 132, relating to Japanese Patent Application JP-A-59-34402, there is described a turbine shaft for a steam turbine. This turbine shaft of a single steam turbine has in its interior an axial bore, into which there is centrally introduced a cooling fluid, which flows out again on both sides at the ends of the bore.

SUMMARY OF THE INVENTION

It is accordingly an object of the invention to provide a turbine shaft of a steam turbine having internal cooling, and also a method of cooling a turbine shaft, that overcome the above-mentioned disadvantages of the prior art devices and methods of this general type, that withstands the, in particular locally occurring, high operational thermal loads in such a way that it exhibits long-term stability.

With the foregoing and other objects in view there is provided, in accordance with the invention, a turbine shaft for a steam turbine having a rotation axis, including:

a first blading region of a first turbine section disposed along the rotation axis;

a second blading region of a second turbine section disposed along the rotation axis;

a bearing region disposed between the first blading region and the second blading region, the first blading region, the second blading region and the bearing region together defining an interior therein functioning as a cooling line for passing cooling steam in a direction of the rotation axis and together defining a circumferential surface;

at least one outflow line connected to the cooling line for discharging the cooling steam; and at least one inflow line connected to the cooling line for supplying an inflow of the cooling steam, the cooling steam cooling highly temperature-loaded regions of the bearing region and the first and second blading regions.

Through the cooling line running in the interior of the turbine shaft, cooling steam can be passed in the direction of the rotation axis through the turbine shaft and can be directed through the outflow line. In this way, both a highly thermally loaded region of the turbine shaft, in particular the steam-inflow region, can be cooled from inside and at the circumferential surface and in the region of fastenings for the moving blades. The cooling line can be inclined relative to the rotation axis or can run so as to be wound relative to the latter, in which case it permits a transport of cooling steam in the direction of the rotation axis. Furthermore, cooling of the moving blades, in particular their roots, which moving blades can be anchored in the turbine shaft, can also be carried out. It goes without saying that, depending on the manufacture of the cooling line, the outflow line and the inflow line may constitute part of the cooling line. It also goes without saying that more than one cooling line may be provided, in which case a plurality of cooling lines are connected to one another and can each be connected to one or more outflow lines and inflow lines respectively. It is likewise possible to dispose outflow lines, adjacent in the direction of the rotation axis, at predeterminable distances apart and to connect them to the cooling line. Cooling of shaft sections subjected to high thermal loads can therefore be effected without considerable outlay on pipelines, casing leadthroughs and integration in the turbine control system. Such a high configuration outlay would be necessary, for example, when cooling a turbine shaft by uses of cold steam from the outside through the casing and the guide blades up to the turbine shaft in order to directly cool the circumferential surface of the turbine shaft.

The turbine shaft is preferably suitable for a single-line steam turbine having a high-pressure turbine section and an intermediate-pressure turbine section. Here, the turbine shaft may consist of two turbine segments connected to one another in the bearing region, each turbine shaft segment having a cooling line, and the cooling lines merging into one another in the bearing region. Each turbine shaft segment or the entire turbine shaft may in this case be produced from a respective forging. It is thereby possible for the highly thermally loaded steam-inflow region of the intermediate-pressure turbine section, which is in particular of double-flow construction, to be cooled with steam from the high-pressure turbine section. Since, in comparison with the high-pressure section, markedly higher volumetric flows and thus larger shaft diameters and longer blades are necessary in the intermediate-pressure section as a result of lower steam pressures, the thermomechanical stressing of the moving-blade roots and of the turbine shaft in the intermediate-pressure section is greater than in the high-pressure section. In addition, since in each case similar temperatures prevail in the high-pressure section and the intermediate-pressure section, the material characteristics of the turbine shaft, such as, for example, creep strength and notched impact strength, are likewise similar, as a result of which the intermediate-pressure section has to be evaluated as being more critical than the high-pressure section on account of the higher thermomechanical loading of the intermediate-pressure section. These problems are preferably solved by virtue of the fact that the turbine shaft in the intermediate-pressure section can be cooled by cooling steam both in its interior, particularly the shaft center, and at its circumferential surface, in particular in the region of the moving-blade roots. Steam is preferably directed from the high-pressure turbine section from the exhaust-steam region or between two stages through a radial bore into the interior of the shaft. On account of the pressure gradient, the cooling steam flows through the bored-out high-pressure and intermediate-pressure shaft into the intermediate-pressure turbine section. In particular in the case of a double-flow construction of the intermediate-pressure turbine section, steam issues from the turbine shaft preferably under a cover plate of the turbine shaft (shaft screen) of the steam-inflow region of the intermediate-pressure turbine section and, on account of film-cooling effects, leads to lowering of the temperature of the turbine shaft in the steam-inflow region and in the region of the first turbine stages. Depending on the application, the cooling steam can also flow out between two axially spaced-apart turbine stages or can be used for cooling moving blades, which in particular are of hollow construction at least in certain regions. The pressure difference between the steam-discharge region of the high-pressure turbine section and the steam-inlet region of the intermediate-pressure turbine section may, for example, be between 4 bar and 6 bar. By appropriate dimensioning of the cross-section of the cooling line, the steam flow can be regulated in such a way that sufficient cooling capacity is also ensured over a wide line range of the steam turbine.

Heat insulation for preventing a radial heat flow is preferably provided in the bearing region in which the turbine shaft can be mounted on a bearing. By a reduction in the heat transfer from the cooling steam to the material of the turbine shaft, excessive heating of the bearing is avoided. Here, an intermediate space, which can be made as an annular gap, is preferably provided between the cooling line and the turbine-shaft material. There is a fluid, preferably cooling steam, in this intermediate space, and this fluid insulates and thus prevents intensive heat transfer by forced convection from the cooling steam, flowing through the cooling line, to the turbine shaft. Here, the cooling line, in the bearing region, is preferably provided with an insulating tube which is surrounded by the cavity. The insulating tube preferably has at least one opening leading to the cavity. Through the opening, in particular a bore, a pressure balance is achieved between the cavity and the cooling line, as a result of which deformation of the insulating tube, due to the high cooling-steam pressure which occurs during steady-state operation of the steam turbine, is prevented.

The second blading region is preferably of double-flow construction and serves to accommodate intermediate-pressure blading. Such a turbine shaft is used in a steam turbine having a high-pressure turbine section and a double-flow intermediate-pressure turbine section. It is likewise possible for the second blading region to be of single-flow construction, the turbine shaft in this case preferably being used in a steam turbine having a single-flow intermediate-pressure turbine section. The outflow line preferably leads out in a steam-inflow region of the intermediate-pressure moving blades, in particular in the region of a shaft screen of the turbine shaft.

The cooling line is preferably a bore that is largely parallel to the rotation axis and in particular is a central bore. A cooling line configured as a bore can also be made subsequently in the turbine shaft in an especially simple and accurate manner. In the case of an assembled turbine shaft, a central bore of the same diameter is preferably made in each turbine shaft section, so that a single cooling line with the same diameter is formed when the turbine shaft sections are joined together. The inflow line, like the outflow line, preferably connects the circumferential surface to the cooling line. In this way, cooling steam, in particular steam of a high-pressure turbine section, can be passed from the circumferential surface at one end of the turbine shaft through the interior of the turbine shaft into the steam-inflow region of the second blading region. This is especially advantageous in the case of a single-line high-pressure turbine shaft and intermediate-pressure turbine shaft, since steam can therefore be passed from the steam-discharge region of the high-pressure turbine section into the steam-inflow region of the intermediate-pressure turbine section. The inflow line and/or the outflow line is preferably an essentially radial bore. Such a bore can also be made in a simple manner after the manufacture of the turbine shaft, in which case such a bore can be connected in a precise manner to a cooling line designed as an axial bore. The diameter of a bore as well as the number of a plurality of bores for the inflow line and the outflow line depend on the quantity of steam provided for the cooling.

The turbine shaft preferably has recesses for accommodating turbine moving blades, the outflow line preferably leading into one of these recesses. It is also possible here for cooling steam to be passed for cooling purposes into a blade cooling line of a turbine moving blade. In this case, a recess for accommodating a turbine moving blade can be made slightly larger than the blade root of the respective moving blade, so that a space into which steam can flow for cooling the blade root is formed between a corresponding blade root and the turbine shaft. This space can also be formed by passages which are connected to the outflow line and/or to one another. From a recess into which an outflow line leads, a branch line preferably leads to the circumferential surface of the turbine shaft. In addition to the cooling of the blade roots, cooling of the circumferential surface and thus of the turbine shaft is thereby also achieved from the outside. It is likewise possible for the outflow line to lead out at the circumferential surface between axially spaced-apart recesses. In the case of a double-flow construction of the second blading region, the outflow line preferably leads out in a cavity formed by a shaft screen, the shaft screen serving to divide the inflowing steam into the two flows. Cooling of the first moving-blade rows of the intermediate-pressure turbine section, in particular of their blade roots and of their blade bodies, is preferably effected. By the outflow line and/or branch line leading out at the shaft surface, film cooling of the shaft surface, in particular in the region of the turbine blades (first turbine stage) nearest the steam-inflow region, is also achieved.

The inflow line preferably connects the steam-discharge region of the high-pressure turbine section to the cooling line, in which case steam can be passed from there through the interior of the turbine shaft into the intermediate-pressure turbine section. It is likewise possible for the inflow line to lead from the circumferential surface between two axially spaced-apart moving-blade rows of the first blading region into the cooling line.

The object directed towards a method of cooling a turbine shaft of a steam turbine is achieved in that, in the case of a turbine shaft having a first blading region for accommodating the high-pressure moving blades and a double-flow second blading region for accommodating the intermediate-pressure moving blades, steam is passed from the steam region of the first blading region through the interior of the turbine shaft over a bearing region to the second blading region. Here, the steam flow in the interior of the turbine shaft can be regulated by suitable dimensioning of a corresponding cooling line, which in particular is made as a bore, in such a way that adequate cooling of the turbine shaft is also ensured over a wide power range. Since there is a pressure difference between the high-pressure turbine section and the intermediate-pressure turbine section even in the part-load range of the steam turbine, satisfactory functioning of the method is ensured even in the part-load range. Due to a cooling line made as an axial, preferably central, bore, the tangential stresses in the interior of the turbine shaft will possibly increase by about double the amount in comparison with a turbine shaft without a bore. However, this higher stress, which may be present, on the turbine shaft is more than compensated for by the markedly improved material properties on account of the internal cooling of the turbine shaft. The method is also suitable in the case of a turbine shaft which is composed of at least two turbine shaft sections (turbine shaft segments), the turbine shaft sections being joined together in the bearing region.

Other features which are considered as characteristic for the invention are set forth in the appended claims.

Although the invention is illustrated and described herein as embodied in a turbine shaft of a steam turbine having internal cooling, and also a method of cooling a turbine shaft, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
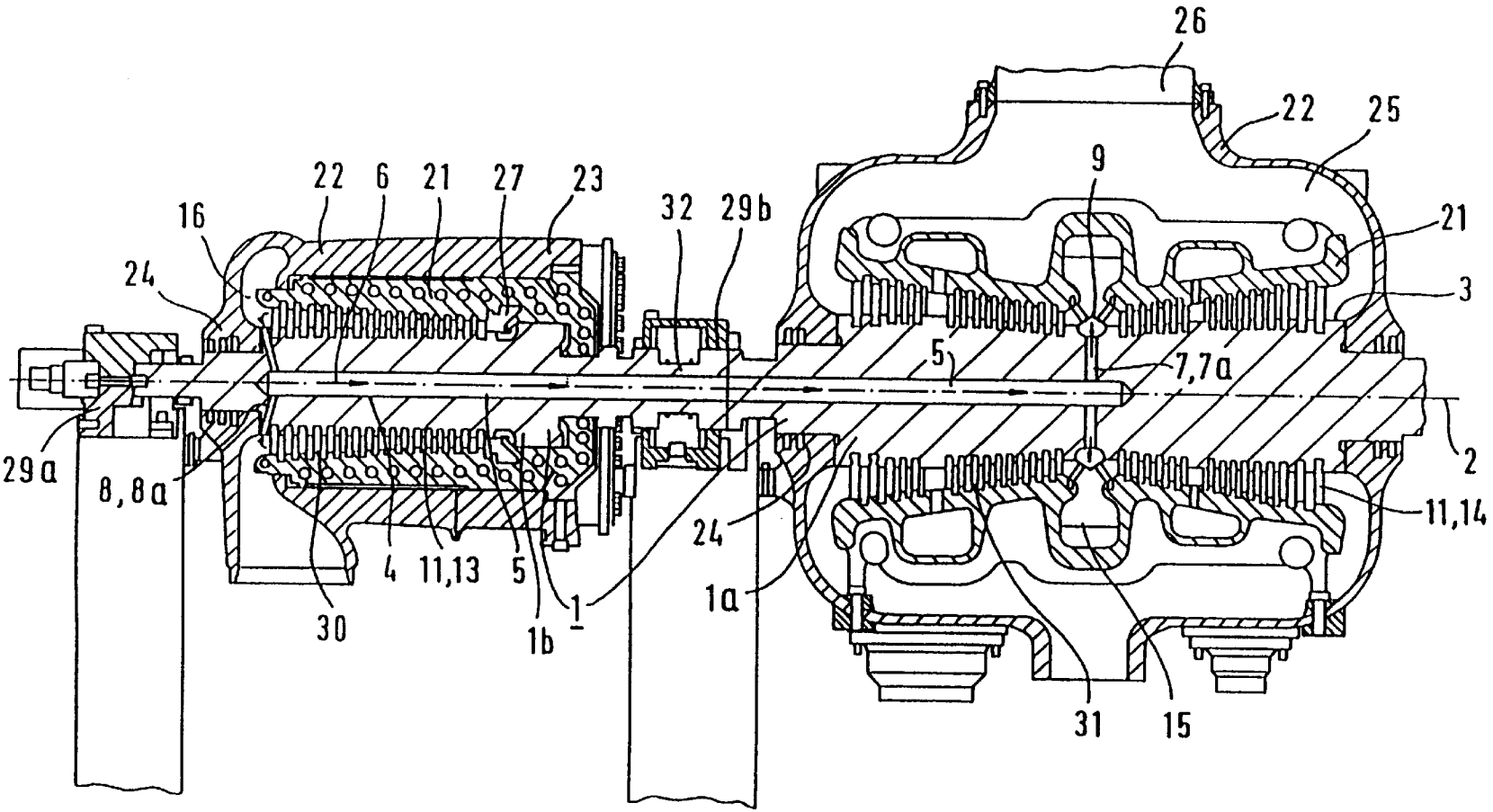
FIG. 1 is a diagrammatic, longitudinal sectional view through a steam turbine having a high-pressure turbine section and an intermediate-pressure turbine section with a turbine shaft according to the invention.

In all the figures of the drawing, sub-features and integral parts that correspond to one another bear the same reference symbol in each case. Referring now to the figures of the drawing in detail and first, particularly, to FIG. 1 thereof, there is shown a steam turbine 23, 25 having a turbine shaft 1 extending along a rotation axis 2. The steam turbine has a high-pressure turbine section 23 and an intermediate-pressure turbine section 25, each of which has an inner casing 21 and an outer casing 22 enclosing the inner casing 21. The high-pressure turbine section 23 is of a pot-type construction. The intermediate-pressure turbine section 25 is of double-flow construction. It is likewise possible for the intermediate-pressure turbine section 25 to be of a single-flow construction. Along the rotation axis 2, a bearing **29*b* is disposed between the high-pressure turbine section 23 and the intermediate-pressure turbine section 25, the turbine shaft 1 having a bearing region 32 in the bearing 29*b*. The turbine shaft 1 is mounted on a further bearing 29*a* next to the high-pressure turbine section 23. The high-pressure turbine section 23 has a shaft seal 24 in the region of the bearing 29*a*. The turbine shaft 1 is sealed off from the outer casing 22 of the intermediate-pressure turbine section 25 by two further shaft seals 24. Between a high-pressure steam-inflow region 27 and a steam-discharge region 16, the turbine shaft 1 in the high-pressure turbine section 23 has a high-pressure moving blading 11, 13. The high-pressure moving blading 11, 13, with associated moving blades (not shown in any more detail), constitutes a first blading region 30. The intermediate-pressure turbine section 25 has a central steam-inflow region 15. The turbine shaft 1 has assigned to the steam-inflow region 15 a radially symmetrical shaft screen 9—a cover plate—on the one hand for dividing the steam flow into the two flows of the intermediate-pressure turbine section 25 and also to prevent direct contact of the hot steam with the turbine shaft 1. The turbine shaft 1 has in the intermediate-pressure turbine section 25 a second blading region 31 having the intermediate-pressure moving blades 11, 14. The hot steam flowing through the second blading region 31 flows out of the intermediate-pressure turbine section 25 from an outflow connection 26** to a low-pressure turbine section (not shown) fluidically connected downstream.

The turbine shaft 1 is composed of two turbine shaft sections 1*a* and 1*b,* which are firmly connected to one another in the region of the bearing 29*b*. Each of the turbine shaft sections 1*a,* 1*b* has a cooling line 5 configured as a central bore 5 along the rotation axis 2. The cooling line 5 is connected to the steam-discharge region 16 via an inflow line 8 having radial bores 8*a*. In the intermediate-pressure turbine section 25, the coolant line 5 is connected to a cavity (not shown in any more detail) below the shaft screen 9. The inflow lines 8 are made as radial bores 8*a,* as a result of which "cold" steam can flow from the high-pressure turbine section 23 into the central bore 5. Via an outflow line 7, which is also configured in particular as a radially directed bore 7*a,* the steam passes through the bearing region 32 into the intermediate-pressure turbine section 25 and reaches the circumferential surface 3 of the turbine shaft 1 there in the steam-inflow region 15. The steam 6 flowing through the cooling line 5 has a markedly lower temperature than the reheated steam flowing into the steam-inflow region 15, so that effective cooling of the first moving-blade rows 14 of the intermediate-pressure turbine section 25 as well as of the circumferential surface 3 in the region of the moving-blade rows 14 is ensured.

Figure 2:
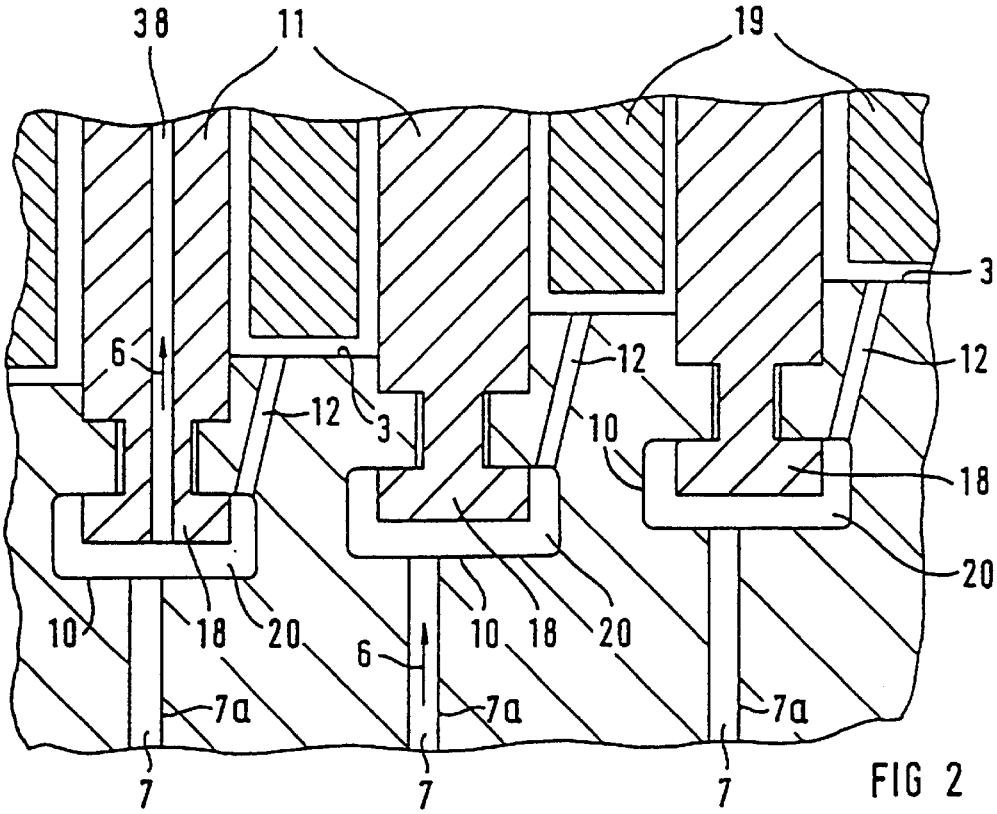
FIG. 2 is a fragmented, sectional view of a detail of the turbine shaft in a steam-inflow region of the intermediate-pressure turbine section.
Figure 3:
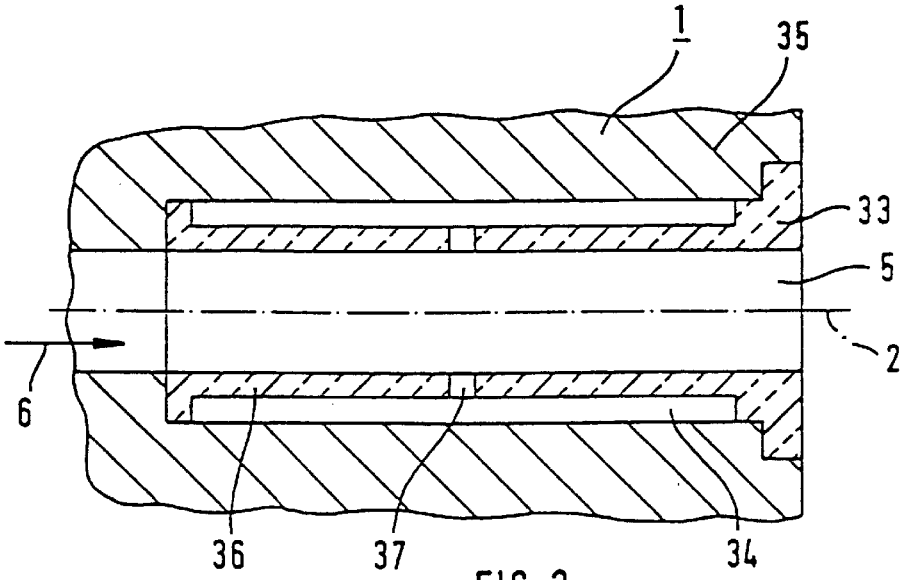
FIG. 3 is a fragmented, sectional view of a detail of the turbine shaft in a bearing region.

FIG. 2 shows a detail of the steam-inflow region 15 of the intermediate-pressure turbine section 25 on an enlarged scale. Corresponding moving blades 11, 14 are in each case disposed with their respective blade roots 18 in recesses 10 of the turbine shaft 1. The recesses 10 each have passages 20 around the blade roots 18, the passages 20 being connected, on the one hand, to the outflow line 7, which runs radially relative to the rotation axis 2 and, on the other hand, to one branch line 12 each. The branch line 12 leads from the recess 10 to the circumferential surface 3 and faces a guide blade 19 of the steam turbine. The steam 6 flowing out of the outflow lines 7 passes into the passages 20 of the recess 10 and thus cools the blade roots 18, which are each disposed in a corresponding recess. The steam 6 flows from the passages 20 through a respective branch line 12 to the circumferential surface 3 of the turbine shaft 1 and thus also cools the circumferential surface 3 between moving blades 11 adjacent to one another in the direction of the rotation axis 2. At a moving blade 11 which has a blade cooling line 38, steam 6 likewise flows through the blade cooling line 38 and cools the moving blade 11 from inside out. This is shown schematically at one moving blade 11. FIG. 3 shows a detail of the bearing region 32 of the turbine shaft section 1*b* of the high-pressure turbine section 23. In the bearing region 32, the cooling line 5 is widened to a larger diameter along a predetermined axial length. Heat insulation 33, formed of an insulating tube 36, is put into the cooling line 5 which is thus widened. The insulating tube 36 has an inside diameter that corresponds to the diameter of the cooling line 5 that is not widened. The outside diameter of the insulating tube 36 is smaller than the enlarged diameter of the cooling line 5, so that a cavity 34, in particular an annular gap 34, remains between the insulating tube 36 and the turbine-shaft material 35. The insulating tube 36 has openings 37 leading to the cavity 34. During operation of the turbine shaft 1, the cavity 34 is filled with cooling steam 6, which brings about heat insulation between the turbine-shaft material 35 and the cooling steam 6 flowing permanently through the cooling line 5. This ensures that heating of the bearing 29*b* during the operation of the turbine shaft 1 is kept at a low level.

The invention is distinguished by a turbine shaft which has a cooling line via which there is connected at least one inflow line to a high-pressure turbine section and at least via one outflow line to the steam-inflow region of the intermediate-pressure turbine section. The inflow line, the cooling line, and the outflow line form a line system in the interior of the turbine shaft, through which line system "cold" steam can be passed from the high-pressure turbine section to the thermo-mechanically highly stressed steam-inflow region of the intermediate-pressure turbine section. In this way, both the moving blades, in particular the moving-blade roots, and the circumferential surface of the turbine shaft in the especially highly stressed steam-inflow region of the intermediate-pressure turbine section, which is in particular of double-flow construction, are cooled without a high construction cost. In a bearing region between the high-pressure turbine section and the intermediate-pressure turbine section, heat insulation is provided in the interior of the turbine shaft, by which heat insulation, excessive heating of a bearing of the turbine shaft is avoided.

We claim:

1. A turbine shaft for a steam turbine having a rotation axis, comprising:

a first blading region of a first turbine section disposed along the rotation axis;

a second blading region of a second turbine section disposed along the rotation axis, wherein said second blading region has recesses formed therein for accommodating turbine moving blades;

a bearing region disposed between said first blading region and said second blading region, said first blading region, said second blading region and said bearing region together defining an interior therein functioning as a cooling line for passing cooling steam in a direction of the rotation axis and together defining a circumferential surface;

at least one outflow line connected to said cooling line for discharging the cooling steam said at least one outflow line leading out to said circumferential surface between two of said recesses being axially spaced-apart recesses; and at least one inflow line connected to said cooling line for supplying an inflow of the cooling steam, the cooling steam cooling highly temperature-loaded regions of said bearing region and said first and second blading regions.

2. The turbine shaft according to claim 1, including a heat insulation disposed in said bearing region around said cooling line for reducing a radial heat flow.

3. The turbine shaft according to claim 2, wherein said bearing region has a bearing wall, and said heat insulation has a recess formed therein defining a cavity formed between said heat insulation and said bearing wall.

4. The turbine shaft according to claim 3, wherein said heat insulation is an insulating tube.

5. The turbine shaft according to claim 4, wherein said insulating tube has at least one opening formed therein leading to said cavity.

6. The turbine shaft according to claim 1, wherein said first and second blading regions serve to accommodate high-pressure moving blades and intermediate-pressure moving blades having a steam-inflow region of a combined high-pressure/intermediate-pressure steam turbine, said at least one outflow line leading out to the steam-inflow region of the intermediate-pressure moving blades.

7. The turbine shaft according to claim 1, wherein said second blading region is of double-flow construction.

8. The turbine shaft according to claim 6, wherein said second blading region is of single-flow construction.

9. The turbine shaft according to claim 1, wherein said at least one inflow line extends from said circumferential surface to said cooling line.

10. The turbine shaft according to claim 9, wherein said first blading region has a steam discharge region and said at least one inflow line leads out into said steam-discharge region.

11. The turbine shaft according to claim 1, wherein said cooling line is a central bore disposed substantially parallel to the rotation axis.

12. The turbine shaft according to claim 1, wherein said at least one inflow line is a radial bore.

13. The turbine shaft according to claim 1, wherein said second blading region has recesses formed therein for accommodating turbine moving blades, said at least one outflow line leading out to said circumferential surface between two of said recesses being axially spaced-apart recesses.

14. The turbine shaft according to claim 13, wherein said second blading region has a branch line formed therein, said branch line extending from said one of said recesses to said circumferential surface.

15. The turbine shaft according to claim 3, wherein said cavity is an annular gap.

16. The turbine shaft according to claim 1, wherein said at least one outflow line is a radial bore.

17. The turbine shaft according to claim 9, wherein said first blading region has recesses formed therein for accommodating turbine moving blades, and said at least one inflow line leading out between two of said recesses being axially spaced-apart recesses.

18. The turbine shaft according to claim 1, wherein said second blading region has recesses formed therein for accommodating turbine moving blades, said at least one outflow line leading out to one of said recesses.

19. The turbine shaft according to claim 1, wherein said second blading region has recesses formed therein for accommodating turbine moving blades having blade cooling lines, said at least one outflow line leading out to the blade cooling line of one of the turbine moving blades.

20. A method of cooling a turbine shaft in a steam turbine, the turbine shaft carrying high-pressure moving blades of a high-pressure turbine section in a first blading region and intermediate-pressure moving blades of an intermediate-pressure turbine section in a double-flow second blading region, the second blading region having recesses formed therein for accommodating turbine moving blades, the method which comprises:

passing steam from a steam region of the first blading region through an interior of the turbine shaft over a bearing region to the second blading region; and discharging steam through an outflow line leading out to a circumferential surface of the turbine shaft between two of the recesses that are axially spaced-apart recesses.

* * * * *